US005619941A

United States Patent [19]

Papajewski et al.

[11] Patent Number: 5,619,941

[45] Date of Patent: Apr. 15, 1997

[54] CLAMP FOR A BUTTONHOLE SEWING MACHINE

[75] Inventors: Gerd Papajewski, Stutensee; Rudy Papajewski, deceased, late of Stutensee, both of Germany, by Edith Papajewski, executrix

[73] Assignee: AMF Reece, Inc., Mechanicsville, Va.

[21] Appl. No.: 604,250

[22] Filed: Feb. 21, 1996

[51] Int. Cl.[6] ..... D05B 3/06

[52] U.S. Cl. ..... 112/76

[58] Field of Search ..... 112/66, 68, 67, 112/76, 65, 70, 75, 73

[56] References Cited

U.S. PATENT DOCUMENTS

| | | | |
|---|---|---|---|
| 655,650 | 8/1900 | Dixon | 112/73 |
| 1,197,639 | 9/1916 | Kiewicz | 112/76 |
| 1,265,382 | 5/1918 | Ray | 112/76 |
| 1,379,894 | 5/1921 | Allen | 112/76 |
| 1,739,059 | 12/1929 | Carlson | 112/76 |
| 1,823,522 | 9/1931 | Allen | 112/76 |
| 2,040,260 | 5/1936 | Kenny | 112/76 |
| 2,510,014 | 5/1950 | Faulkner | 112/76 |
| 2,963,999 | 12/1960 | Braun et al. | 112/76 |
| 2,986,105 | 5/1961 | Maxant | 112/76 |
| 3,039,410 | 6/1962 | Graham et al. | 112/67 |
| 3,847,101 | 11/1974 | Tolle | 112/294 |
| 4,181,083 | 1/1980 | Bajer et al. | 112/67 |
| 4,549,492 | 10/1985 | Albrecht et al. | 112/76 |

*Primary Examiner*—Ismael Izaguirre
*Attorney, Agent, or Firm*—James Creighton Wray

[57] ABSTRACT

A clamp for a buttonhole sewing machine includes two curved cantilevered arms which arch forward and downward to parallel feet portion. The clamp is supported on an extension of a movable clamping plate and moves with the clamping plate. A lever compresses a spring, pushing the clamp into firm engagement with the workpiece on the movable clamping plate. A detent holds the spring compressed and the clamp engaged until the end of the cycle, when the detent is released and the spring pushes the clamp upward so that the workpiece may be moved.

12 Claims, 1 Drawing Sheet

CLAMP FOR A BUTTONHOLE SEWING MACHINE

BACKGROUND OF THE INVENTION

The present invention relates to an improved clamping mechanism used to hold clothing in sewing machines to make buttonholes. Specifically, this invention allows the user to quickly clamp a garment in which a buttonhole is to be formed. The invention quickly releases the garment once the buttonhole stitching and cutting has been completed. That allows for greater automation of the buttonhole sewing and forming process and greater throughput for the operator.

The prior art does not allow the process to be done quickly and easily. While many previous inventions allow the garment to be held firmly in place, needs exist for improved ease of use and the ability to clamp and unclamp quickly.

SUMMARY OF THE INVENTION

An objective of the present invention is to remedy the disadvantages of the prior art by providing an apparatus that allows users to work quickly and effortlessly on pieces of clothing that are to have buttonholes formed in them. During the stitching process, it is imperative that the cloth be held firmly in place. Any slippage would ruin the process and render the garment unusable. Additionally, the clamp used to hold the garment in place is easily clamped and is automatically unclamped to speed up the process of buttonhole forming.

In a preferred embodiment, an operator moves a pedal or foot button which pushes a ball stud on a toggle downward. The toggle moves to a bottom, stable position. The toggle compresses a spring and applies force through a link to a hinged clamp. The clamp secures the garment against a clamping plate while a buttonhole is sewn and cut. As soon as the buttonhole is cut, the toggle is automatically lifted by a cam. The spring provides quick release of the clamp by forcing the toggle and link upward and pulling the clamp open, once the stitching and cutting has been completed.

A clamp for a buttonhole sewing machine has a movable clamping plate mounted on a sewing machine. A tail bracket is mounted on the clamping plate. A tail pivot pin connects a tail pivot to the tail bracket. A clamp has curved cantilevered clamp arms extending from shoulders. The shoulders are connected to the tail pivot to pivot the clamp between a closed, clamped position and an open, unclamped position. The arms curve forward and downward, with parallel feet at the ends for clamping a work piece on the clamping plate. A clamp toggle pivot pin connects the tail pivot with a connecting link, which is in turn connected with a toggle by a clamping ball stud. A spring between the tail bracket and the toggle restores the clamp to the unclamped position or maintains the toggle in the clamped position.

A preferred clamp has a clamping guide shaft with a first end engaging the tail bracket and a second end engaging the toggle. An extension on the toggle passes into one end of the spring. A clamping pivot bushing has a large hemispherical end which abuts the tail bracket. An opposite end of the spring surrounds a middle section of the bushing and abuts the large end. The clamping guide shaft extends axially through the helical compression spring.

The embodiment has a tail bracket with a block section that is attached to the clamping plate, a middle section with a sloped top, and an angled end section. The clamping guide shaft passes through a hole in the angled end section, and the clamping pivot bushing abuts the angled end section.

A preferred clamp has a toggle with sloped bottom to abut the sloped top of the tail bracket, which prevents the connecting link and toggle assembly from going beyond the closed, clamped position of the clamp.

There are two feet, in a preferred clamp. The clamping plate has a opening between where the feet make clamping contact with the clamping plate.

A preferred clamp has the clamping plate with an extension and a rack for engaging a clamping plate drive pinion. A wear plate is attached in a recess in the clamping plate at the place where the clamp feet make contact with the clamping plate.

These and further and other objects and features of the invention are apparent in the disclosure, which includes the above and ongoing written specification, with the claims and drawings.

DETAILED DESCRIPTION OF THE DRAWINGS

Figure 1:
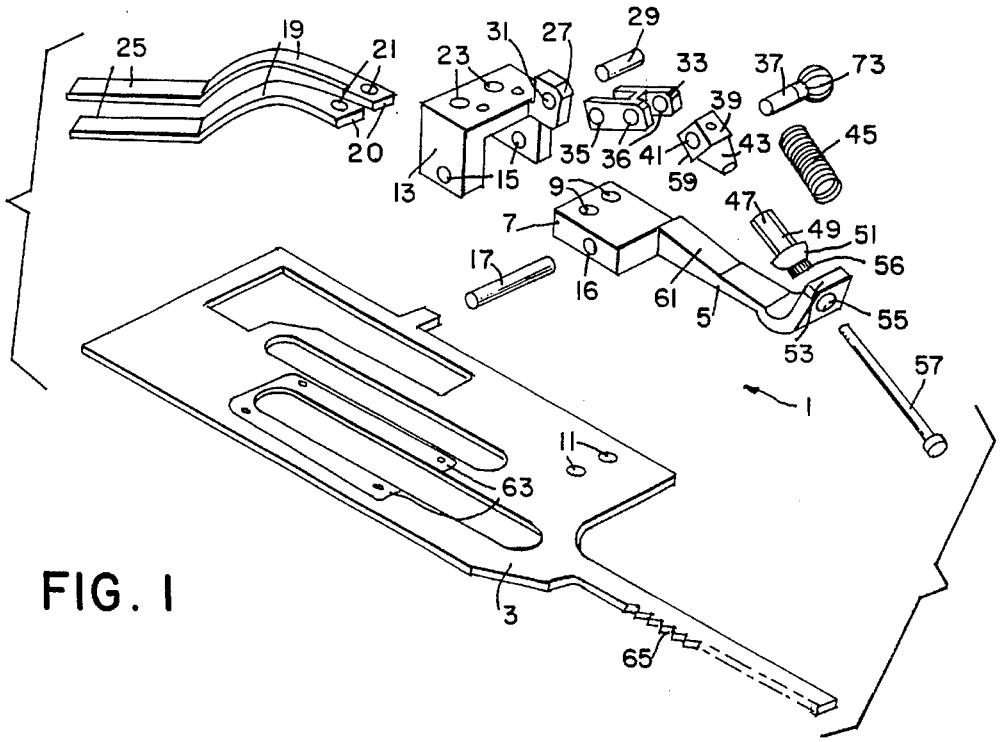
FIG. 1 shows an exploded view of the clamp mechanism.

Referring to FIG. 1, a clamp 1 for a buttonhole sewing machine is shown in an exploded view. The base of the assembly is a clamping plate 3 which is connected to a tail bracket 5 with bolts extending through holes 9 in a block section 7 of the tail bracket 5 and holes 11 in the clamping plate 3.

A tail pivot 13, is connected to the tail bracket 5 using a tail piece pivot pin 17 inserted through holes 15 in the tail pivot 13 and hole 16 in the tail bracket 5. Clamp arms 19 are attached to shoulders 20. The shoulders 20 of the clamp arms 19 is secured to the tail pivot 13 with bolts which extend through holes 21 in the shoulders 20 and through holes 23 in the tail pivot 13. The clamp arms 19 have parallel clamping feet 25 at distal ends of the arms.

An extended lug section 27 of the tail pivot 13 is pivotally connected to a connecting link 33 with a clamp toggle pivot pin 29 passing through a hole 31 in the lug section 27 and holes 35 in the connecting link 33.

A toggle 39 is connected to the connecting link 33 with a clamping ball stud 37 which extends through holes 36 and hole 41 of the toggle 39 via. A conic section 43 of the toggle 39 allows for the attachment of a spring 45 at one end. The opposite end of the spring 45 is attached to a middle section 49 of the clamping pivot bushing 47. A larger end 51 of the clamping pivot bushing 47 abuts the tail bracket 5 at a hole 55 in an angled, end section 53. A clamping guide shaft 57 passes through the hole 55 of the angled, end section 53 and passes through an axial hole 56 of the clamping pivot bushing and passes through the spring 45 to the toggle 39.

The toggle 39 has a sloped bottom 59 that abuts sloped top 61 of the tail bracket 5 when the toggle 39 is pressed downward by the clamping ball stud 37. The spring 45 holds the toggle 39 downward in a stable position, with the clamp in a closed, clamped position.

The clamping plate 3 has a depressed section 63 where a facing plate is inserted for cooperating with the feet 25 during clamping. The clamping plate 3 has a gear rack 65 to move the clamping plate 3 back and forth during the stitching of the buttonhole.

In operation, the clamping ball stud 37 moves the toggle 39 downward. The toggle 39 moves to a bottom, stable position. The toggle 39 compresses the spring 45 and applies force through the connecting link 33 to the tail pivot 13 and clamp arms 19. The feet 25 on the clamp arms 19 secure the garment against the clamping plate 3, while a buttonhole is sewn and cut. As soon as the buttonhole is cut, the toggle 39 is automatically lifted by a cam and lever. The spring 45 provides quick release of the clamp by forcing the toggle 39 outward and connecting link 33 upward and pulling the clamp open, once the stitching and cutting has been completed.

Figure 2:
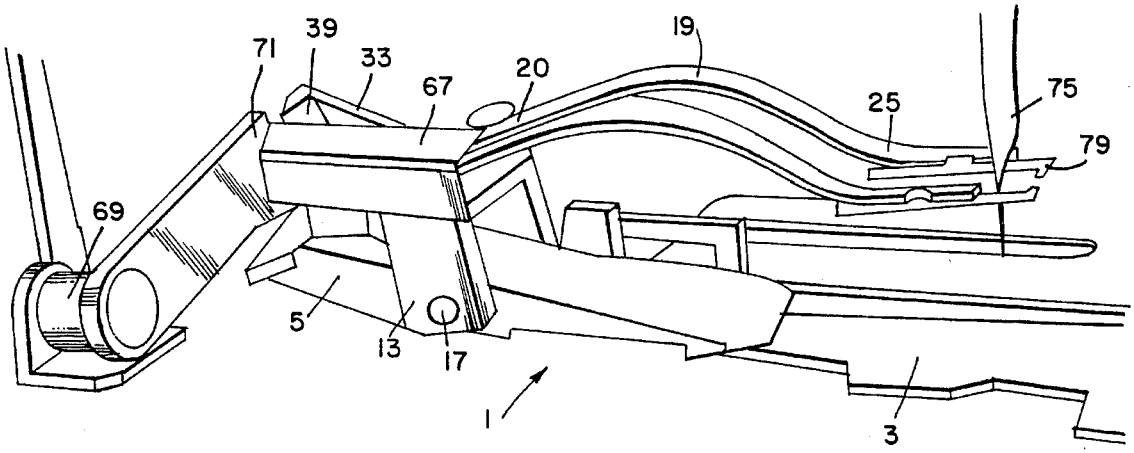
FIG. 2 shows the clamp of FIG. 1 mounted in a buttonhole sewing machine.

Referring to FIG. 2, a clamp 1 mounted in a buttonhole sewing machine. The clamping plate 3 is set into the buttonhole sewing machine. The tail bracket 5 is secured to the plate, and the tail pivot 13 is connected to the bracket with a tail piece pivot pin 17.

In this figure, the toggle 39 and the connecting link 33 can be seen. Their connection to the tail pivot is hidden, in this view, by a channel 67. The operator of the sewing machine steps on a pedal which turns shaft 69 and lever 71 to move the channel 67 downward. The channel moves the ball 73 on the ball pin 37 downward, moving the toggle 39 downward and extending the link past its center until the toggle 39 abuts the slope 61. That tips, extends, and locks the tail pivot 13 and the clamping arms in the closed, clamped position to clamp the workpiece in the clamp.

The clamping arms 19 are connected to the tail pivot 13 at the shoulders 20 of the clamp arms. The workpiece is clamped between the feet 25 of the clamp and the clamping plate 3. Leveling extensions 75 to the feet 25 and a needle 79 are also shown in FIG. 2.

After a knife is cut through the workpiece, a cam turns shaft 69 and raises lever 71 and channel 67. The ball is lifted by the channel 67, lifts the toggle 39 and releases the clamp.

While the invention has been described with reference to specific embodiments, modifications and variations of the invention may be construed without departing from the scope of the invention, which is defined in the following claims.

We claim:

1. A clamp apparatus for a buttonhole sewing machine comprising a movable clamping plate for mounting on a sewing machine, a tail bracket mounted on the clamping plate, a tail pivot, a tail pivot pin connecting the tail pivot to the tail bracket, a clamp having curved cantilevered clamp arms and having shoulders, the shoulders interconnecting first ends of the arms and being connected to the tail pivot for pivoting the clamp with the tail pivot on the tail pivot pin between a closed, clamped position and an open, unclamped position, said arms arching forwardly and downwardly to parallel feet at second ends of the arms for clamping a work piece between the feet and the clamping plate, a connecting link, a clamp toggle pivot pin connecting the tail pivot and the connecting link, a toggle, a clamping ball stud pivotally connecting the connecting link to the toggle, and a spring connected to the tail bracket and to the toggle for restoring the clamp to the unclamped position and maintaining the toggle in the clamped position.

2. The apparatus of claim 1, further comprising a clamping guide shaft passing through the spring and having first and second ends, the first end engaging the tail bracket and the second end engaging the toggle.

3. The apparatus of claim 2, further comprising a clamping pivot bushing with a large hemispherical end, having a middle section and having an axial hole, the large hemispherical end abutting the tail bracket, the spring being connected to the bushing at the middle section and surrounding the clamping guide shaft.

4. The apparatus of claim 3, wherein the tail bracket further comprises a block section that is attached to the clamping plate, a middle section with a sloped top, and an angled end section, the angled end section having a hole that accommodates the clamping guide shaft and the clamping pivot bushing abutting the angled end section.

5. The apparatus of claim 4, wherein the toggle has a sloped bottom which abuts the sloped top of the tail bracket for preventing the connecting link and toggle assembly from going beyond the closed clamped position of the clamp.

6. The apparatus of claim 1, wherein the feet comprise two feet, on distal ends of two arms, and wherein the clamping plate has a needle-receiving opening between where the feet make contact with the clamping plate.

7. The apparatus of claim 1, wherein the clamping plate further comprises an extension and a rack on the extension for engaging a clamping plate drive pinion.

8. The apparatus of claim 1, further comprising a wear plate attached to a recess in the clamping plate at a place where the feet make contact with the clamping plate.

9. A method of clamping a work piece on a feed plate in a buttonhole sewing machine comprising the steps of moving a clamping plate and tail bracket on a sewing machine, pivoting a tail pivot on the tail bracket, moving a clamping ball stud downward, moving a toggle downward with the clamping ball stud, rotating a connecting link with the toggle, extending and rotating the tail pivot with the connecting link, compressing a spring between the toggle and the tail bracket connected to the clamping plate, moving arms and feet of a clamp toward the clamping plate with the tail pivot, clamping the work piece between the feet and the clamping plate.

10. The method of claim 9, further comprising raising the clamping ball stud, thereby raising the toggle, lifting the link and permitting the spring to move the toggle and link, thereby pivoting the tail pivot toward the toggle with the link and lifting the clamping arms with the tail pivot to an unclamped position.

11. The method of claim 9, further comprising moving a ball on the clamping ball stud through a channel while moving the clamping plate and the tail bracket.

12. The method of claim 11, further comprising raising and lowering the ball.

* * * * *